United States Patent [19]

Itoh

[11] 4,396,129

[45] Aug. 2, 1983

[54] DEVICE FOR EMERGENTLY RELIEVING PRESSURE

[75] Inventor: Takanori Itoh, Sakai, Japan

[73] Assignee: Hitachi Shipbuilding & Engineering Company Limited, Osaka, Japan

[21] Appl. No.: 278,883

[22] Filed: Jun. 29, 1981

[51] Int. Cl.[3] ..... B65D 90/34

[52] U.S. Cl. ..... 220/89 A; 137/68 R; 220/266

[58] Field of Search ..... 220/89 A, 266; 137/68 R, 69, 70, 71; 141/18, 94, 95; 169/58

[56] References Cited

U.S. PATENT DOCUMENTS 3,313,113 4/1967 Maxson et al. ..... 220/89 AX

FOREIGN PATENT DOCUMENTS 73969 3/1952 Denmark ..... 220/89 A
5563498 11/1953 Japan ..... 220/89 A
41-11911 6/1966 Japan ..... 220/89 A
426671 12/1966 Switzerland ..... 220/89 A

*Primary Examiner*—William Price
*Assistant Examiner*—Gary E. Elkins
*Attorney, Agent, or Firm*—Barnes, Kisselle, Raisch, Choate, Whittemore & Hulbert

[57] ABSTRACT

A device for emergently relieving pressure comprising a thin plate having its peripheral portion curved so that its central portion protrudes downward, the peripheral portion being welded to the inner periphery of a hatch coaming provided in a fuel tank, a stiffening plate laid on the central portion of the thin plate, a support beam disposed under the thin plate and extending across the coaming, and a rupture bar connecting the laminate of the thin plate and stiffening plate to the support beam, the rupture bar being adapted to be ruptured before the weld between the peripheral portion of the thin plate and the inner periphery of the coaming is broken.

The device permits accurate release of any abnormal pressure developed in the tank and thus assures the safety of the tank.

11 Claims, 16 Drawing Figures

DEVICE FOR EMERGENTLY RELIEVING PRESSURE

The present invention relates to a device for emergently relieving pressure in a fuel tank for safety purposes when the pressure in the tank grows abnormally high as by an explosion.

It is a usual practice to provide a pressure vessel or the like with a device for automatically releasing the internal gas from the vessel to prevent the vessel from breaking when the internal pressure becomes abnormally high. Conventional devices employed for this purpose, however, are designed to operate at a high pressure and has a relatively small opening area. Thus these devices are not applicable to fuel tanks, such as oil reserve tanks, which require a pressure relief device to operate at a relatively low pressure and to have a large opening area for coping with a drastic pressure variation as is caused by an explosion.

Japanese Utility Model Application No. 53-147271 discloses a simple device which comprises a thin round plate bent downwardly and inwardly and having its entire periphery welded to the inner surface of a cylindrical coaming. This arrangement is designed so that when an abnormally high pressure develops in tank, the downwardly curved plate is caused to bend back upwardly to deform and finally break the weld between the plate and the coaming, with the result that the plate is blown off to release the pressure. However, this device has a drawback that due to production errors there are variations in the pressure at which the plate starts bending back. Thus the plate may start deforming wholly or locally greatly at a pressure below a specified level, or may not deform at all even after the specified pressure has been reached.

The present invention contemplates the provision of a dependable solution to such difficulty. Accordingly, it is the primary object of the invention to provide a device for emergently releasing pressure which, though having a large opening area and operable at a relatively low pressure, is mechanically simple, of low cost, and easy to maintain and which permits accurate release of pressure only when the pressure reaches a specified low value.

In order to achieve this object, the invention provides a device for emergently releasing pressure comprising plate means having its peripheral portion bent in a downward and inward arc so that the central portion of the plate means protrudes downward, said peripheral portion being welded to the inner periphery of a hatch coaming provided on a fuel tank, means for stiffening said central portion of the plate means, a rupture bar connected to the plate means, and means for supporting the rupture bar in the hatch coaming, said rupture bar being adapted to be ruptured before the weld between the peripheral portion of the plate means and the inner periphery of the hatch coaming is broken.

This arrangement assures highly reliable pressure-relief performance, because the plate means is retained by the rupture bar and reinforced by the stiffening means so that no substantial deformation, whether overall or local, can be caused to the plate means before the rupture bar is broken, thus there being no likelihood of premature release of pressure, and because the plate means is so designed as to be easily blown off when the rupture bar is broken under the specified pressure.

The various features and advantages of the invention will become apparent from the following description of embodiments with reference to the accompanying drawings in which.

Figure 8:
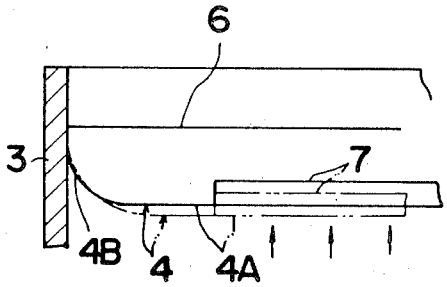
Figure 9:
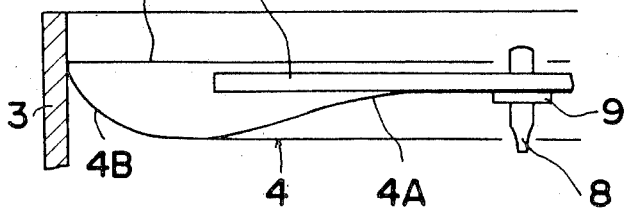
Figure 10:
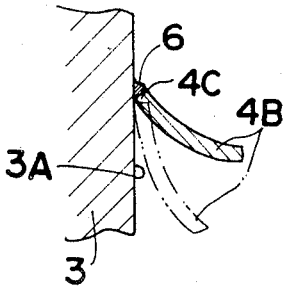
Figure 11:
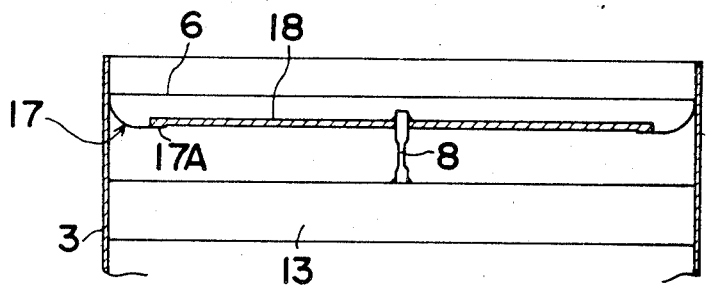
Figure 12:
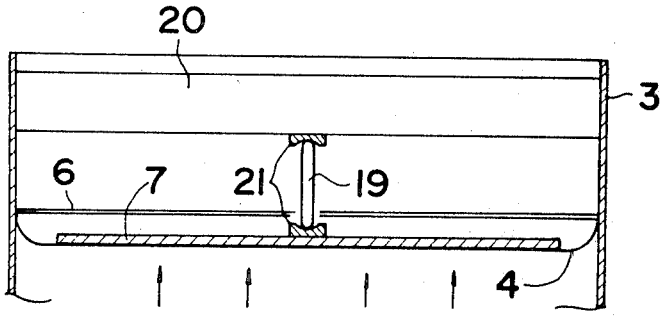
Figure 13:
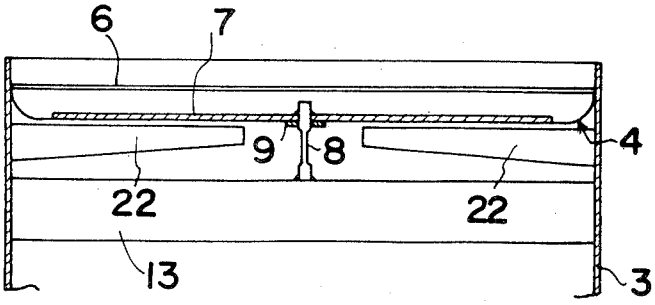
Figure 14:
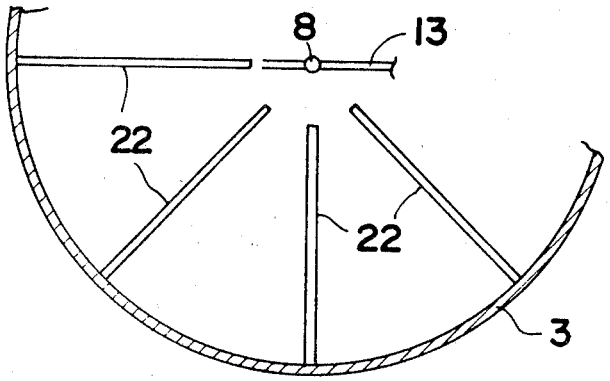

FIGS. 8 to 10, inclusive, are schematic illustrations showing the way in which the device according to the invention works;

FIG. 11 is a vertical section showing a second embodiment of the invention;

FIG. 12 is a vertical view in section showing a third embodiment of the invention;

FIG. 13 is a vertical section showing an improved embodiment of the invention;

FIG. 14 is a plan view in cross section of the improved embodiment shown in FIG. 13.

Figure 15:
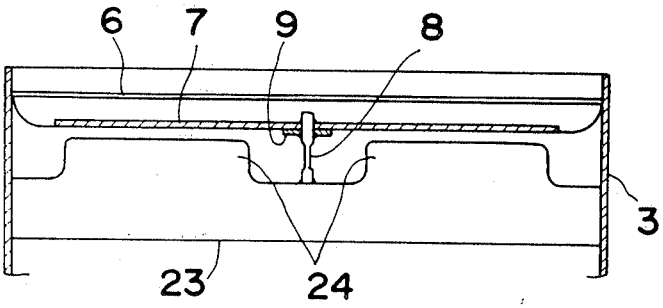
Figure 16:
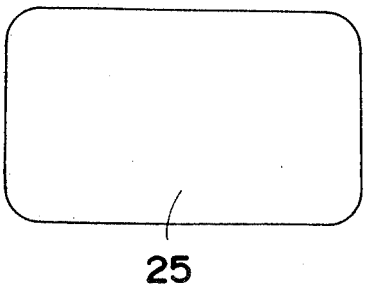

FIG. 15 is a vertical section showing another improved embodiment of the invention; and FIG. 16 is a top plan view showing a modified form of plate means according to the invention.

Referring first to FIGS. 1 to 5, inclusive, reference numeral 1 generally indicates a tank which has a hatch opening generally indicated by reference numeral 2. A cylindrical hatch coaming 3 is fixed to the outer wall of the tank. The opening 5 of the hatch coaming is covered with a thin plate or rupture disc 4, which is formed of steel sheeting or, where corrosion resistance is particularly required, of stainless steel sheeting.

Figure 1:
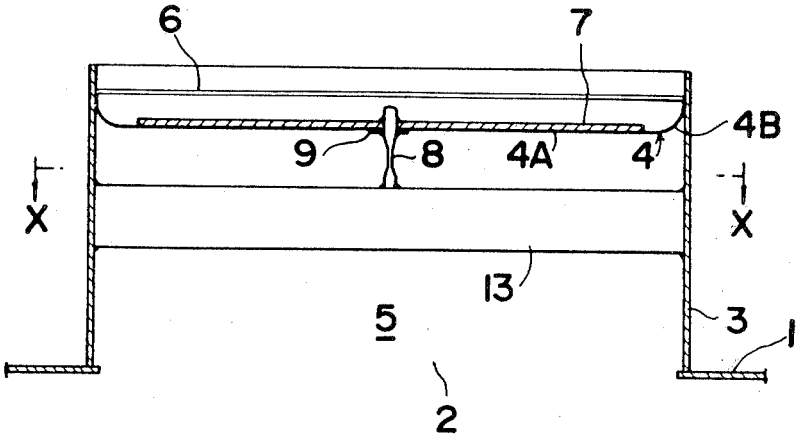
FIG. 1 is a vertical section of a first embodiment of the invention.
Figure 2:
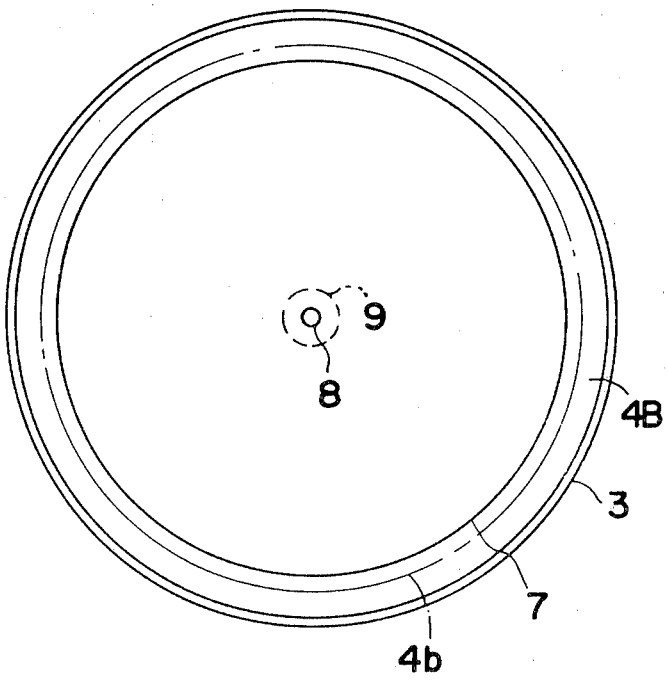
FIG. 2 is a top plan view thereof.
Figure 3:
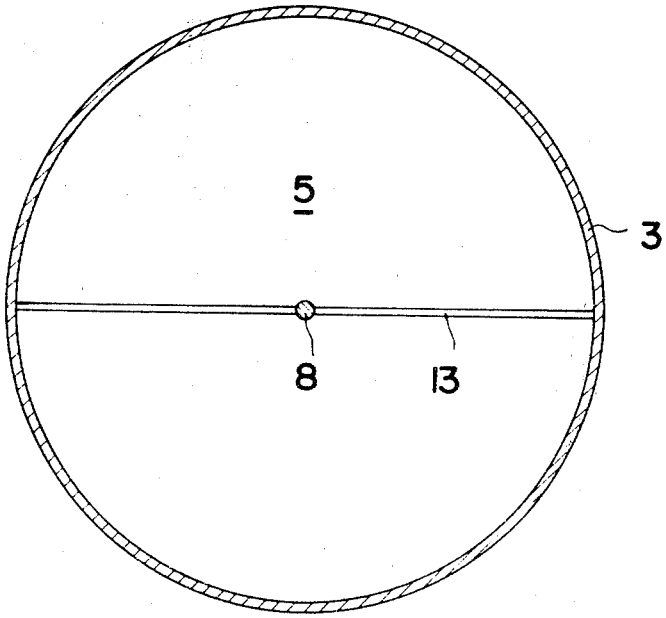
FIG. 3 is a sectional view taken along the line X—X in FIG. 1.
Figure 4:
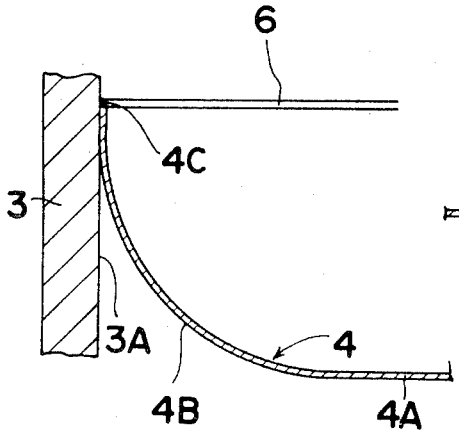
FIGS. 4 and 5 are expanded sectional views of key portions of said first embodiment.
Figure 5:
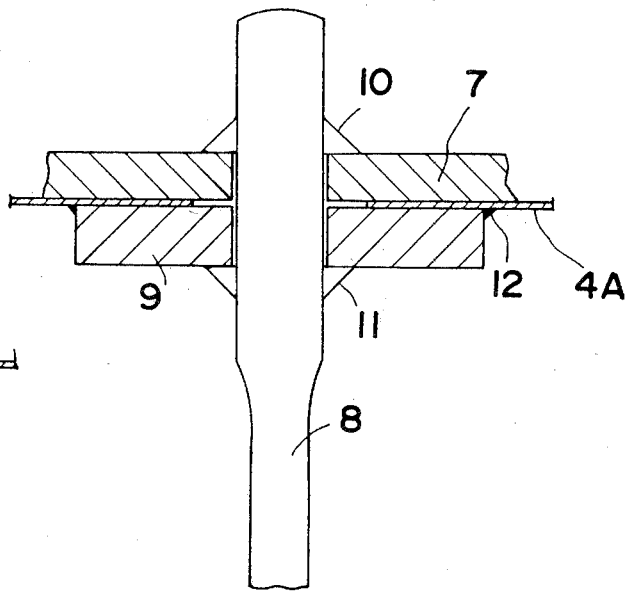

The thin plate 4 is flat in its central portion 4A and is bent in small curvature in its peripheral portion 4B, both portions forming a smooth continuum. In FIG. 2, **4*b* indicates the terminal point of the curve in the peripheral portion 4B, which curve makes the central portion 4A protrude downwardly, that is, inwardly relative to the tank. Fillet welding is effected between the peripheral edge face 4C of the thin plate 4 and the inner peripheral surface 3A of the hatch coaming (FIG. 4). In the embodiment shown, the weld is given so that the hatch coaming inner peripheral surface 3A is tangential relative to the peripheral portion 4B**.

A stiffening plate 7 is disposed on said flat portion 4A of the thin plate 4 concentrically therewith. There is provided a rupture bar 8 which extends through both the stiffening plate 7 and the thin plate 4. The through-hole bored in the thin plate 4 for this purpose is of a larger diameter than the rupture bar 8 allowing for some reasonable limits of machining error. A closure plate 9 is fitted over the rupture bar 8 from the lower end side thereof, said closure plate having a substantially larger diameter than said through-hole. As can be readily seen from FIG. 5, the rupture bar 8, stiffening plate 7, closure plate 9, and thin plate 4 are joined together by welds 10, 11 and 12. The rupture bar 8, at its lower end, is joined to a support beam 13 which extends across the hatch coaming 3.

The rupture bar 8 is so designed that its upper and lower end portions have sufficient strength for jointing purpose and at its intermediate portion the bar is breakable under tensile force acting thereon when the thin plate 4 is subjected to any abnormally high pressure exceeding a certain level developed in the tank 1. In the embodiment shown, the rupture bar 8 is formed thick at its both end portions and substantially thinner at its intermediate portion. The weld 6 between the peripheral edge face 4C of the thin plate 4 and the inner periphery 3A of the hatch coaming 3 is so formed as to withstand any pressure lower than the breaking point of the rupture bar 8 and to retain complete airtightness.

The thin plate 4 alone is very easily deformable, being liable to substantial deformation even under pressures considerably lower than the breaking point of the rupture bar 8. According to the present invention, however, the stiffening plate 7 is disposed on the central portion 4A of the thin plate 4 and the resulting laminate structure is supported by the support beam 13 through the rupture bar 8 so that the thin plate 4 is completely prevented from any substantial deformation under normal pressures in the tank 1. If it is considered necessary, a further stiffener may be provided in addition to the stiffening plate 7.

Figure 6:
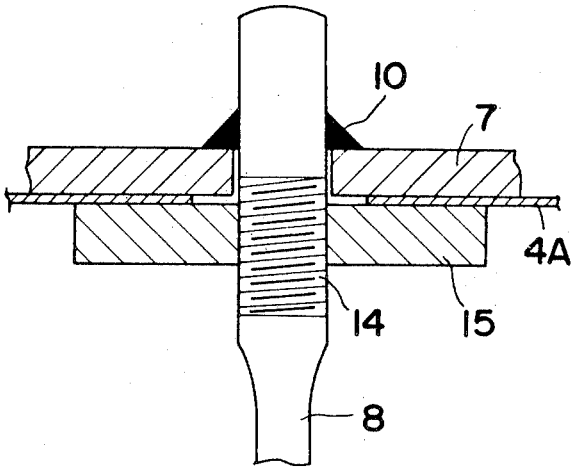
FIGS. 6 and 7 are enlarged fragmentary sectional views showing a modified form of rupture bar employed in said first embodiment.
Figure 7:
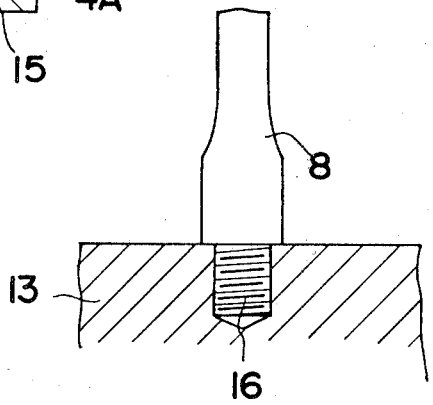

The closure plate 9 formed of sheet metal may be sufficient for the purpose of providing airtightness only, but if it is also required to function as a jig for determining the position for the stiffening plate 7, the closure plate 9 must have a certain degree of thickness that will provide sufficient strength to support the stiffening plate 7. In this connection, the provision of a screw means 14 in the upper portion of the rupture bar 8, as shown in FIG. 6, may make it easier to have the stiffening plate 7 disposed at a level that will permit the rupture disc 4 to have an optimum configuration. For this purpose, the closure plate 15 takes the part of a nut by being screwed on the screw means 14 on the rupture bar 8, and the level of the rupture disc 4 may be determined by adjusting the amount of screw-in of the closure plate 15. Thereafter, the stiffening plate 7 may be welded at 10 to the rupture bar 8. Alternatively, as shown in FIG. 7, a screw means 16 may be provided in the lower end portion of the rupture bar 8, and by adjusting the amount of insertion of the screw means 16 into the support beam 13 it is possible to readily determine a proper position for the thin plate 4 and that for the stiffening plate 7.

The operation of the above described device will now be explained with reference to FIGS. 8 to 10, inclusive. In the upper space 5 within the tank 1, pressures are in action even at normal times. The stiffening plate 7 is rigid but yet has some degree of resiliency. Accordingly, it is liable to a slight deformation under normal internal pressures, with the result that, as indicated by full line in FIG. 8, there occurs some change in the curvature of the peripheral portion 4B of the thin plate 4 as against the original configuration thereof. This deformation is such that the peripheral portion 4B of the thin plate 4 gets nearer to the inner periphery 3A of the hatch coaming 3 than it stands when the internal pressure in the tank presents no influence on the thin metal plate 4 (as shown by imaginary line in FIG. 8). Therefore, no change whatsoever takes place in the angle between the peripheral portion 4B and the hatch coaming inner periphery 3A in the neighborhood of the weld 6 (hereinafter such change referred to as angular change). Hence, such deformation involves no substantial stress upon the weld 6, and the weld 6 will never break under normal internal pressures.

As above described, the flat portion 4A of the thin plate 4 is very low in rigidity and substantially liable to deflection, but since the internal pressure acting on said flat portion 4A is received by the stiffening plate 7, the flat portion 4A is virtually maintained in its original condition, and the internal pressure received by the stiffening plate 7 is passed on to the rupture bar 8. Moreover, since the flat portion 4A covers the entire area, other than the peripheral portion 4B, of the thin plate 4, almost all the pressure imposed on the thin plate 4 is passed on to the rupture bar 8.

The internal pressure in the tank may fluctuate under the influence of temperatures, but the deformation of the thin plate 4 due to such fluctuation merely takes the form of a change in the curvature of the peripheral portion 4B. Since the effect of such pressure change can be absorbed through the deformation of the peripheral portion 4B, no substantial stress will develop in the weld 6. Moreover, there is a very smooth continuity between the flat portion 4A and the peripheral portion 4B. This means that no part of the rupture disc 4 is subject to stress concentration, assuring sufficient fatigue strength.

If, for some reason, the internal pressure influencing the stiffening plate 7 exceeds the tensile strength of the rupture bar 8, the rupture bar 8 is forced to break, whereupon the connection between the stiffening plate 7 and the tank-side support is removed. This, coupled with the fact that the stiffening plate 7 is not directly secured to the thin plate 4, results in substantial deformation of the flat portion 4A, as illustrated in FIG. 9, followed by substantial angular deformation between the hatch coaming inner periphery 3A and said peripheral portion 4B (FIG. 10). The weld 6, simply formed by fillet welding, is easily ruptured by excessive stress caused to develop as a result of the angular deformation. That is, the weld 6 is fractured successively and quickly beginning from the portion thereof to which substantial angular deformation is caused and the thin plate 4 is immediately blown off, thus the opening 5 of the coaming 3 being uncovered to release the abnormal pressure from the tank.

Another embodiment shown in FIG. 11 comprises an annular thin plate 17 welded to the inner periphery of a hatch coaming and having a peripheral portion bent in a small curvature, and a stiffening plate 18 having its outer periphery welded to the internal peripheral edge 17*a* of the thin plate 17.

A still another embodiment shown in FIG. 12 includes a rupture bar 19 liable to buckling or breaking when subjected to compressive force higher than a certain level. In the case of this embodiment, it is necessary that a support beam 20 should be disposed at a level higher than a rupture disc 4. In FIG. 12, reference numeral 21 designates mounting seats for the rupture bar 19.

Depending upon the type of the material stored in the tank, there may be cases where the strength of the pressure relief cap against the negative pressure in the tank is a problem. As solutions to such problem, two improved embodiments are shown in FIGS. 13 to 15, inclusive. The embodiment shown in FIGS. 13 and 14 comprises a plurality of support members 22 against negative pressures disposed at angularly equal intervals between the thin plate 4 and the support beam 13, each adjacent to the thin plate 4, and extending radially from the hatch coaming 3. In the one shown in FIG. 15, supports 24 against negative pressure are integrally formed with a support beam 23.

In the embodiments described above, one rupture bar is centrally provided in the pressure relief cap, but more than one rupture bar may be provided depending upon the breaking strength thereof. Similarly, the mounting position for the rupture bar may be modified in various ways. Further, it is to be understood that the configuration of the pressure relief cap is not limited to the one described herein. For example, it may be a rectangular cap 25 having radiused corners as shown in FIG. 16.

What is claimed is:

1. A device for emergently relieving pressure comprising deformable plate means having a stiffened central portion and a peripheral portion bent in a downward and inward arc so that the central portion of the plate means protrudes downward, said peripheral portion being welded to the inner periphery of a hatch coaming provided on a fuel tank, a rupture bar connected to the plate means, and means for supporting the rupture bar in the hatch coaming, said rupture bar being adapted to be ruptured before the weld between the peripheral portion of the plate means and the inner periphery of the hatch coaming is broken, and said plate means being adapted to be deformed when the rupture bar is broken so that the central portion of the plate means moves upward, whereupon the weld between the plate means and the hatch coaming is broken to allow the plate means to be blown off the hatch coaming.

2. A device as defined in claim 1, wherein said plate means comprises a thin plate having a flat central portion and a peripheral portion bent in a small curvature, and a stiffening plate disposed on the central portion of the thin plate.

3. A device as defined in claim 1, wherein said plate means comprise an annular thin plate welded to the inner periphery of said hatch coaming and bent in a small curvature, and a stiff plate attached to said annular thin plate so as to cover a hole centrally bored therein.

4. A device as defined in claim 1, wherein said rupture bar has a relatively thin intermediate portion.

5. A device as defined in claim 1, wherein said rupture bar supporting means is a support beam extending across the coaming.

6. A device as defined in claim 5, wherein said support beam is positioned below the plate means.

7. A device as defined in claim 5, wherein said support beam is positioned above the plate means.

8. A device as defined in claim 1, wherein the peripheral portion of said plate means is in tangential contact relation to the inner periphery of the coaming.

9. A device as defined in claim 1, wherein support means against negative pressures are provided just under said plate means.

10. A device as defined in claim 5, wherein said rupture bar is threaded at both ends thereof, said both ends being screwed in said plate means and support beam.

11. A device as defined in claim 6, wherein said rupture bar is threaded at both ends thereof, said both ends being screwed in said plate means and support beam.

* * * * *